US009583328B2

(12) United States Patent
Lin

(10) Patent No.: US 9,583,328 B2
(45) Date of Patent: Feb. 28, 2017

(54) LAMP HAVING SYNTHETIC CERAMIC GLASS ELECTRODES

(71) Applicants: SANTOMA (H.K.) LTD., Kowloon (HK); Wen-Fei Lin, New Taipei (TW)

(72) Inventor: Wen-Fei Lin, New Taipei (TW)

(73) Assignees: Santoma (H.K.) Ltd., Kowloon (HK); Wen-Fei Lin, New Taipei (TW)

( * ) Notice: Subject to any disclaimer, the term of this patent is extended or adjusted under 35 U.S.C. 154(b) by 0 days.

(21) Appl. No.: 15/096,586

(22) Filed: Apr. 12, 2016

(65) Prior Publication Data

US 2017/0004960 A1 Jan. 5, 2017

(30) Foreign Application Priority Data

Jul. 2, 2015 (TW) ..... 104210668 U

(51) Int. Cl.

| | |
|---|---|
| ***H01J 61/04*** | (2006.01) |
| ***H01J 17/04*** | (2012.01) |
| ***H01J 61/067*** | (2006.01) |
| ***H01J 61/10*** | (2006.01) |
| ***H01J 61/36*** | (2006.01) |

(52) U.S. Cl.

CPC ..... *H01J 61/0675* (2013.01); *H01J 61/10* (2013.01); *H01J 61/36* (2013.01)

(58) Field of Classification Search

CPC ..... H01J 61/0675; H01J 61/10; H01J 61/36

See application file for complete search history.

(56) References Cited

U.S. PATENT DOCUMENTS

| | | | | |
|---|---|---|---|---|
| 2,462,843 A * | 3/1949 | Cary | ..... | G01N 27/36 204/420 |
| 8,043,490 B2 * | 10/2011 | Auerswald | ..... | G01N 27/283 204/416 |
| 2012/0212121 A1 * | 8/2012 | Lin | ..... | H01J 9/18 313/491 |

* cited by examiner

*Primary Examiner* — Tracie Y Green

(74) *Attorney, Agent, or Firm* — Rosenberg, Klein & Lee

(57) ABSTRACT

The present invention relates to a lamp having synthetic ceramic glass electrodes, which comprises a glass tube, a plurality of synthetic ceramic glass electrodes, and a plurality of connecting members. The plurality of connecting members are disposed between the glass tube and the plurality of synthetic ceramic glass electrodes. The plurality of connecting members have different thermal expansion coefficients. Thereby, by using the plurality of connecting members to connect the plurality of synthetic ceramic glass electrodes, the glass tube and the plurality of synthetic ceramic glass electrodes can be sealed tightly.

13 Claims, 8 Drawing Sheets

LAMP HAVING SYNTHETIC CERAMIC GLASS ELECTRODES

FIELD OF THE INVENTION

The present invention relates generally to a lamp, and particularly to a lamp having synthetic ceramic glass electrodes.

BACKGROUND OF THE INVENTION

A daylight lamp, also called a fluorescent lamp, a sun lamp, or a fluorescent light, is a lighting apparatus. It belongs to a kind of arc light and uses electric power to stimulate mercury vapor in argon or neon ambient for forming plasma and emitting ultraviolet light having a short wavelength. After the ultraviolet light is absorbed by phosphorus, the phosphorus will emit visible light for lighting. The light emitted in this method is fluorescent light.

Take a general fluorescent tube for example. A closed fluorescent tube is filled with low-pressure argon or argon-neon mixture gas and mercury gas. The inner surface of the glass fluorescent tube is coated with phosphorus fluorescent paint. Tungsten filament coils are disposed on both ends of the fluorescent tube. When the power is turned on, the current first passes through the filament for heating and electrons are released. The electrons will transform the gases inside the tube into plasma and amplify the current therein. When the voltage across the two filament sets exceeds a certain value, the fluorescent tube starts to discharge, enabling the mercury vapor to emit ultraviolet light with wavelengths of 253.7 nm and 185 nm. The phosphorus fluorescent paint on the inner surface of the fluorescent tube can absorb the ultraviolet light and emit visible light with longer wavelengths. The color of the emitted light is controlled by the proportion of the phosphorus. The adoption of the glass tube is to avoid leakage of hazardous ultraviolet light and other harmful materials such as mercury.

In the fabrication of lamps according to the prior art, electrode members are disposed on both ends of a fluorescent tube. Inside the fluorescent tube, it is a closed space. The gas inside the closed space is pumped out to make it in the vacuum state. Then the required gas, such as argon or argon-neon mixture gas and mercury gas, is added. The electrodes are fixed inside the fluorescent tube at both ends and used for sealing this fluorescent tube and forming a closed space. Then glue is coated inside the tube before fixing the electrodes at both ends. Nonetheless, the difficult part of this technology is that the glue coated inside the tube tends to flow into the closed spaced of the fluorescent tube and is mixed with the gases therein. This affects the light-emitting efficiency of the lamp.

Furthermore, in order to improve the above problem, electrode members are disposed on both ends outside a fluorescent tube. Glass rings are disposed between the electrode members and the fluorescent tube and used for fixing and sealing the gaps therebetween. Nonetheless, due to the difference in thermal expansion coefficients of the electrode members and the fluorescent tube, after cooling and fixing the rings, the electrode members, and the fluorescent tube, gaps occur, resulting in ineffective sealing of the fluorescent tube.

Accordingly, the present invention improves the sealing structure and provides a lamp having synthetic ceramic glass electrodes.

SUMMARY

An objective of the present invention is to provide a lamp having synthetic ceramic glass electrodes, which uses a plurality of connecting members having different thermal expansion coefficients to connect the glass tube and a plurality of synthetic ceramic glass electrodes and thus enabling tight sealing therebetween.

Another objective of the present invention is to provide a lamp having synthetic ceramic glass electrodes, which uses a glass tube having one or more blocking member for increasing the contact area between the glass tube and the plurality of connecting members, thus enabling tight sealing among the plurality of connecting members, the glass tube, and a plurality of synthetic ceramic glass electrodes. Thereby, the sealing between the glass tube and the plurality of synthetic ceramic glass electrodes can be enhanced.

In order to achieve the objectives and efficacies as described above, the present invention provides a lamp having synthetic ceramic glass electrodes, which comprises a glass tube, a plurality of synthetic ceramic glass electrodes, and a plurality of connecting members. The plurality of connecting members are disposed at one or more ends of the glass tube. The plurality of synthetic ceramic glass electrodes are disposed at both ends of the glass tube, respectively. One or more of the plurality of synthetic ceramic glass electrodes is connected with the plurality of connecting members, which have different thermal expansion coefficients, respectively.

In addition, the differences between the thermal expansion coefficients of the plurality of connecting members adjacent to the plurality of synthetic ceramic glass electrodes and the thermal expansion coefficients of the plurality of synthetic ceramic glass electrodes are smaller than the differences between the thermal expansion coefficients of the plurality of connecting members away from the plurality of synthetic ceramic glass electrodes and the thermal expansion coefficients of the plurality of synthetic ceramic glass electrodes.

Moreover, the differences between the thermal expansion coefficients of the plurality of connecting members away from the plurality of synthetic ceramic glass electrodes and the thermal expansion coefficient of the glass tube is greater than the differences between the thermal expansion coefficients of the plurality of connecting members adjacent to the plurality of synthetic ceramic glass electrodes and the thermal expansion coefficient of the glass tube.

Besides, the present invention further comprises one or more blocking member disposed at one ore more end of the glass tube. The plurality of connecting members are disposed against the one or more blocking member.

DETAILED DESCRIPTION

In order to make the structure and characteristics as well as the effectiveness of the present invention to be further understood and recognized, the detailed description of the present invention is provided as follows along with embodiments and accompanying figures.

Figure 1:
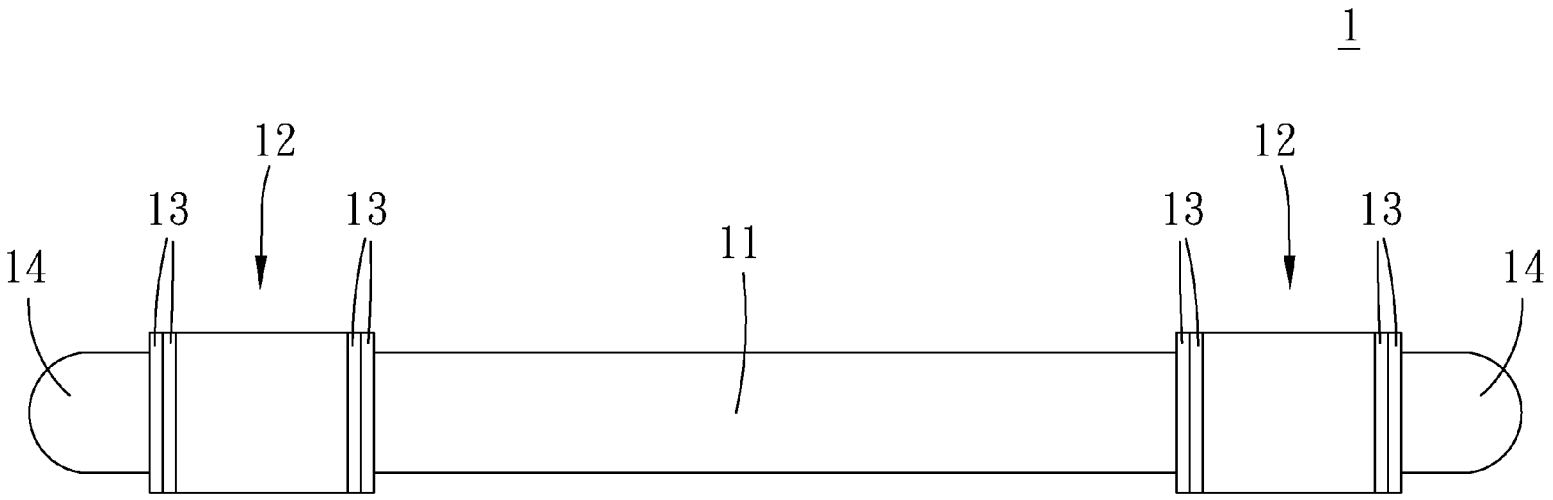
FIG. 1 shows a schematic diagram of the lamp having synthetic ceramic glass electrodes according to the first embodiment of the present invention.
Figure 2:
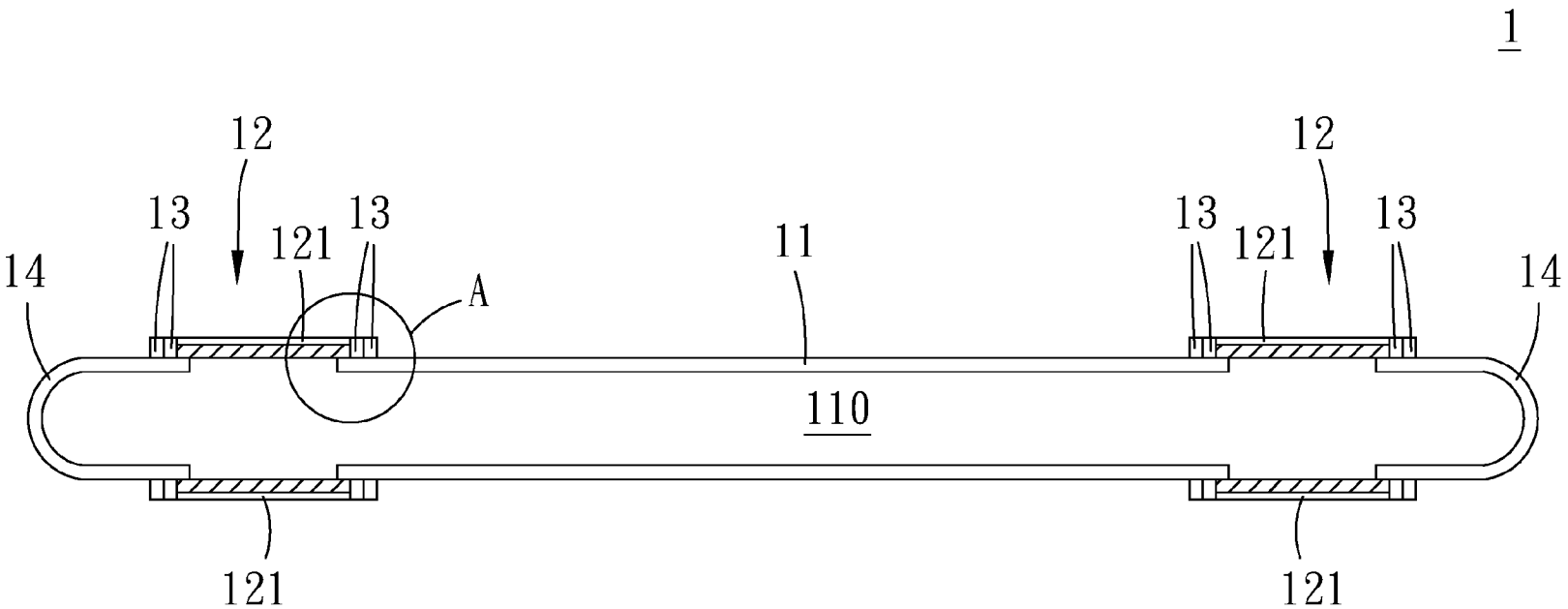
FIG. 2 shows a cross-sectional view of the lamp having synthetic ceramic glass electrodes according to the first embodiment of the present invention.
Figure 3:
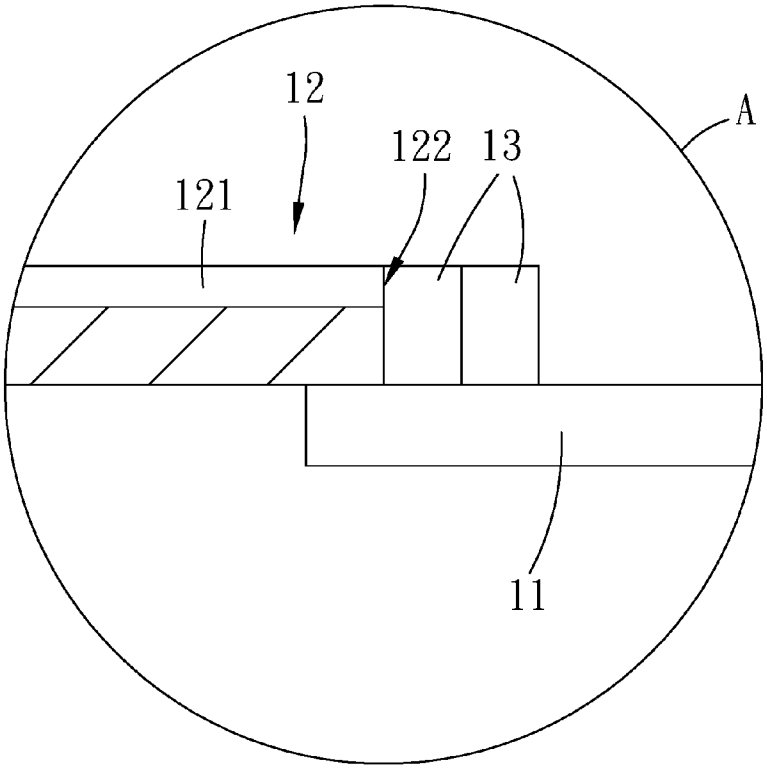
FIG. 3 shows an enlarged view of the region A in FIG. 2 according to the present invention.

Please refer to FIG. 1, FIG. 2, and FIG. 3, which show a schematic diagram, a cross-sectional view, and an enlarged view of the region A of the lamp having synthetic ceramic glass electrodes according to the first embodiment of the present invention. As shown in the figures, the present embodiment relates to a lamp having synthetic ceramic glass electrodes, which is applicable to fluorescent lamps, infrared lamps, or lamps of various types. It is not limited to a specific type of lamp. The lamp 1 having synthetic ceramic glass electrodes according to the present embodiment comprises a glass tube 11, a plurality of synthetic ceramic glass electrodes 12, and a plurality of connecting members 13. The plurality of connecting members 13 according to the present embodiment are disposed at both ends of the glass tube 11, respectively. According to the present embodiment, there are two synthetic ceramic glass electrodes 12 disposed at both ends of the glass tube 11, respectively. The plurality of connecting members 13 are connected to the two synthetic ceramic glass electrodes 12, respectively, and the glass tube 11. In addition, the plurality of connecting members 13 according to the present embodiment can be disposed at only one end of the glass tube 11.

The main body of the glass tube 11 according to the present embodiment can be formed by boron-silicate material, lead-free glass, or quartz glass. The glass tube 11 is coated with phosphorous on the inner surface. The shape of the glass tube 11 can be tubular, U-shaped, or rectangular. According to the present embodiment, the glass tube 11 is tubular.

Besides, the material of the plurality of synthetic ceramic glass electrodes 12 can be phosphorous ceramic glass synthetics. The temperature stability of the dielectric constant of this material is better. It also has the properties of high dielectric constant and high secondary-electron emission efficiency. Alternatively, those ceramic glass synthetics without phase transition points above −30° C. can be adopted as well. The plurality synthetic ceramic glass electrodes 12 can be fabricated using ceramic glass synthetics as the material and through a powder injection molding or a dry stamp press process. Moreover, the plurality of synthetic ceramic glass electrodes 12 according to the present embodiment further comprise a plurality of conductive layers 121 disposed on the outer surface of the plurality of synthetic ceramic glass electrodes 12, respectively. The material of the plurality of conductive layers 121 can be silver or carbon.

In addition, the main material of the plurality of connecting members 13 is glass powder. The glass powder is die-cast to form a ring-shaped glass ingot. Alternatively, the glass powder is processed to form a gel member. In the manufacturing process, the plurality of connecting members 13 can be controlled to have different thermal expansion coefficients, respectively, and identical or similar softening temperatures.

According to the present embodiment, the plurality of connecting members 13 are ring-shaped glass ingots. First, the plurality of connecting members 13 are supplied by vibration through a vibration plate and put around both ends of the glass tube 11. Then, side end surfaces 122 of the plurality of synthetic ceramic glass electrode are put against the plurality of connecting members 13. Finally, the plurality of connecting members are heated and melted, and thus enabling the plurality of connecting members 13 to connect with the glass tube 11 and the side end surfaces 122 of the synthetic ceramic glass electrodes 12.

Nonetheless, the connections of the plurality of connecting members 13 with the glass tube 11 and with the synthetic ceramic glass electrodes 12 are excellent, enabling tight sealing between the glass tube 11 and the synthetic ceramic glass electrodes 12. This is mainly attributed to different thermal expansion coefficients of the plurality of connecting members 13. Take the plurality of connecting members 13 located at one end of the glass tube and the synthetic ceramic glass electrode 12 for example. The difference between the thermal expansion coefficient of the connecting member 13 of the synthetic ceramic glass electrode 12 adjacent to the synthetic ceramic glass electrode 12 and that of the synthetic ceramic glass electrode 12 is smaller than the difference between the thermal expansion coefficient of the connecting member 13 of the synthetic ceramic glass electrode 12 away from the synthetic ceramic glass electrode 12 and that of the synthetic ceramic glass electrode 12. The thermal expansion coefficient of the connecting member 13 adjacent to the synthetic ceramic glass electrode 12 is between 115 and 125, with a preferred value of 120.

The difference between the thermal expansion coefficient of the connecting member 13 of the synthetic ceramic glass electrode 12 away from the synthetic ceramic glass electrode 12 and that of the glass tube 11 is smaller than the difference between the thermal expansion coefficient of the connecting member 13 of the synthetic ceramic glass electrode 12 adjacent to the synthetic ceramic glass electrode 12 and that of the synthetic ceramic glass electrode 12. In contrast to the connecting member 13, the thermal expansion coefficient of the synthetic ceramic glass electrode 12 is between 92 and 103, with a preferred value of 97.

In addition, by adjusting the composition of the glass powder of the plurality of connecting members 13, the softening temperatures of the plurality of connecting members 13 can be controlled to be identical or similar and lower than the softening temperature of the glass tube 11. According to the present embodiment, the softening temperatures of the plurality of connecting members 13 is approximately between 545° C. and 555° C., with a preferred value of 550° C.

When a thermal treatment is performed on the synthetic ceramic glass electrode 12 and the glass tube 11, the heat will make the volume of the glass tube 11 and the synthetic ceramic glass electrode 12 expand. Because the thermal coefficients of the glass tube 11 and the synthetic ceramic glass electrode 12 are different, under the thermal treatment, the expansion in volume for the glass tube 11 and the synthetic ceramic glass electrode 12 are different. Thereby, according to the present embodiment, the plurality of connecting members 13 having different thermal expansion coefficients are adopted. By using the plurality of connecting members 13, the thermal expansion coefficients of the glass tube 11 and the synthetic ceramic glass electrode 12 are made closer for connecting the glass tube 11 and the synthetic ceramic glass electrode 12.

When the thermal treatment is performed on the synthetic ceramic glass electrode 12, the glass tube 11, and the plurality of connecting members 13, the temperature is raised to 550° C. for reaching the softening temperature of the plurality of connecting members 13. The neighboring surfaces of the plurality of connecting members 13 are softened and connected to one another. The side surface of the connecting member 13 adjacent to the synthetic ceramic glass electrode 12 is attached to the side end surface 122 of the synthetic ceramic glass electrode 12. On the other hand, the connecting member 13 away from the synthetic ceramic glass electrode 12 is attached to the surface of the glass tube 11. According to the above description, the plurality of connecting members 13 are located between the side end surface 122 and the surface of the glass tube 11. In addition, the plurality of connecting members 13 can flow after they are softened and be able to fill and seal the gaps between the synthetic ceramic glass electrode 12 and the glass tube 11, achieving tight sealing therebetween. Moreover, when the plurality of connecting members 13 are heated to the softening temperature and start to flow, the acting force among the molecules of the plurality of connecting members 13 is not destroyed completely. Besides, the acting force among glass molecules is strong, limiting its fluidity. Hence, the plurality of connecting members 13 will not flow into the glass tube 11 and affecting the light-emitting effect of the lamp 1. After cooling and fixing, gaps will not be generated between the glass tube 11 and the synthetic ceramic glass electrode 12 again after volume contraction caused by huge difference in thermal expansion coefficients between the glass tube 11 and the synthetic ceramic glass electrode 12. After this step of thermal treatment is finished, the glass tube 11 is purged and a mixed gas is filled into the glass tube 11.

Furthermore, in addition to the ring-shaped glass ingots, the plurality of connecting members 13 can be gels made by glass powder as well. Gels with different thermal expansion coefficients are coated between the glass tube 11 and the plurality of synthetic ceramic glass electrodes 12. The rest steps are identical to the embodiment for the ring-shaped glass ingots. Hence, the details will not be described again. Nonetheless, the lamp 1 according to the present embodiment further comprises a plurality of glass caps 14 embedded into the other side of the plurality of synthetic ceramic glass electrodes 12, respectively, and opposing to the glass tube 11 for sealing the glass tube 11. Thus, the glass tube 11 includes an accommodating space 110. A mixture of inert gas and metal vapor (not shown in the figure) can be filled in the accommodating space 110. Of course, the plurality of connecting members 13 can be used to connect the glass cap 14 and the synthetic ceramic glass electrode 12, as shown in FIG. 1 and FIG. 2. The disposition method has been described above. Hence, the details will not be described again.

The present invention improves the drawbacks in the prior art. According to the prior art, the sealed gap between the glass tube and the electrode done by thermal treatment and in the condition of volume expansion can be opened again after cooling due to different contraction volume among various components. Accordingly, the present invention provides a lamp having synthetic ceramic glass electrodes, which uses the plurality of connecting members 13 to be sealed in the gap between the glass tube 11 and the synthetic ceramic glass electrodes 12. The plurality of connecting members 13 have different thermal expansion coefficients. They are used to reduce indirectly the difference in thermal expansion coefficients between the glass tube 11 and the synthetic ceramic glass electrodes 12. Thereby, the differences in volume change among the glass tube 11, the plurality of synthetic ceramic glass electrodes 12, and the plurality of connecting members 13 are not significant. Hence, it is avoided that the sealed gaps are opened again.

Figure 4:
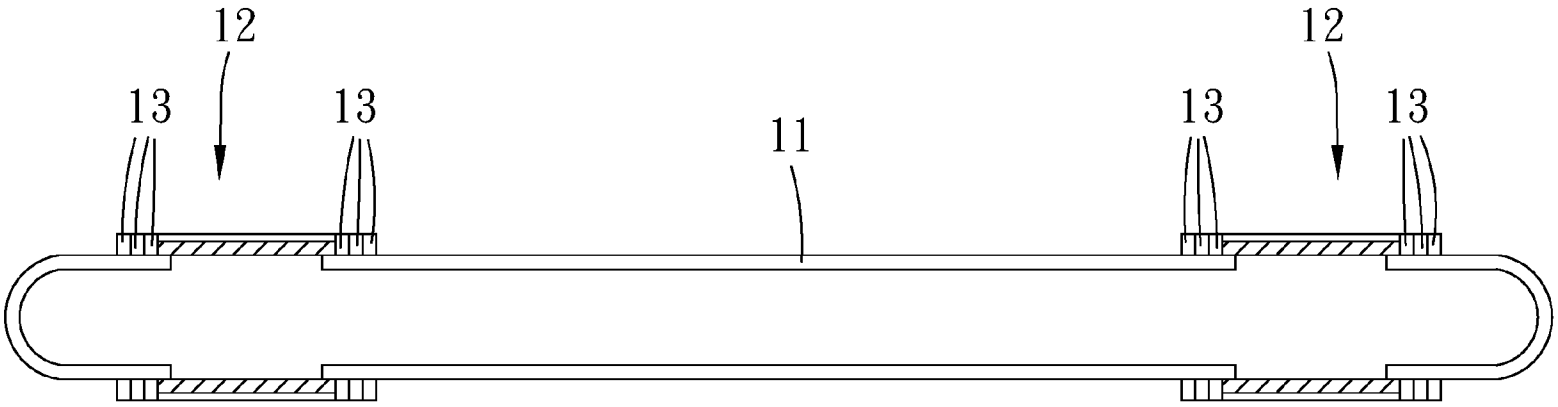
FIG. 4 shows a cross-sectional view of the lamp having synthetic ceramic glass electrodes according to the second embodiment of the present invention.

Please refer to FIG. 4, which shows a cross-sectional view of the lamp having synthetic ceramic glass electrodes according to the second embodiment of the present invention. As shown in the figure, the difference between the present embodiment and the first one is that, according to the present embodiment, three ring-shaped glass ingots are adopted. In other words, three or more connecting members 13 are disposed between the glass tune 11 and the synthetic ceramic glass electrode 12. By using this method, the fixed and adjacent glass tube 11, the differences in thermal expansion coefficients among the plurality of synthetic ceramic glass electrodes 12, and the plurality of connecting members 13 are insignificant, making the volume structure in thermal treatment will change little after cooling and fixing. This method can be applied to the situation when the difference in thermal expansion coefficients between the glass tube 11 and the synthetic ceramic glass electrodes 12 is significant. The plurality of connecting members 13 are used for making the thermal expansion coefficients of the glass tube 11 and the synthetic ceramic glass electrode closer. Thereby, the problem of inability in sealing after cooling and fixing the glass tube 11 and the synthetic ceramic glass electrode 12 owing to significant difference in thermal expansion coefficients.

Figure 5:
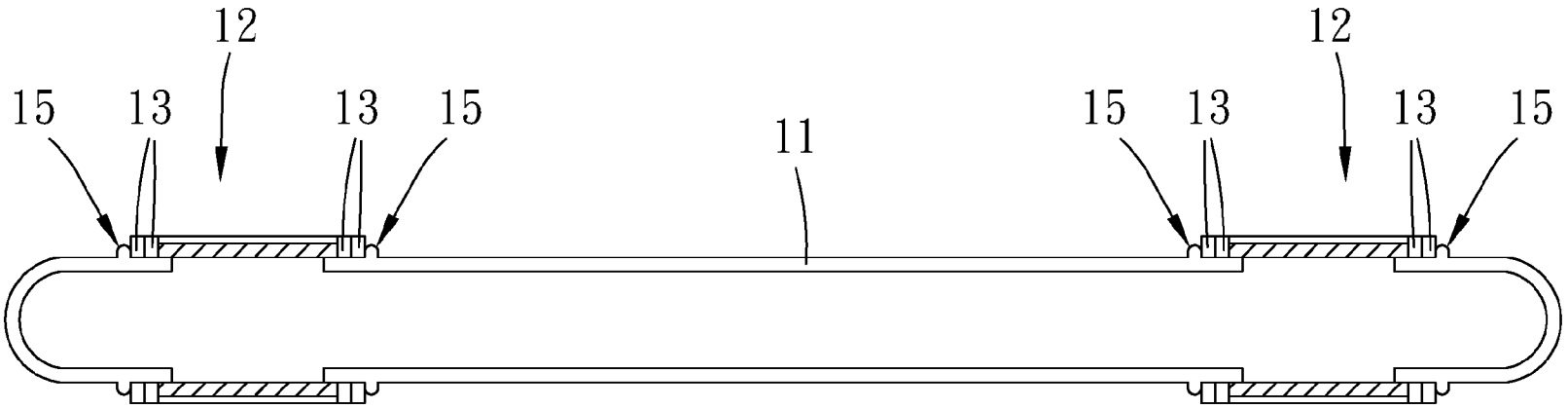
FIG. 5 shows a cross-sectional view of the lamp having synthetic ceramic glass electrodes according to the third embodiment of the present invention.

Please refer to FIG. 5, which shows a cross-sectional view of the lamp having synthetic ceramic glass electrodes according to the third embodiment of the present invention. As shown in the figure, the difference between the present embodiment and the first one is that, according to the present embodiment, one or more blocking member 15 is disposed at one or more end of the glass tube. The plurality of connecting members 13 are put around one or more end of the glass tube 11 and against the one or more blocking member 15. One side of the plurality of synthetic ceramic glass electrodes 12 presses against the plurality of connecting members 13, respectively. The plurality of blocking members 15 are used for limiting the location of the plurality of synthetic ceramic glass electrodes 12 on the glass tube 11, namely, limiting the length of the plurality of glass tubes 11 extending into the plurality of synthetic ceramic glass electrodes 12. The plurality of glass caps 14 also include one ore more blocking member 15 for limiting the location of the plurality of synthetic ceramic glass electrodes 12 on the plurality of glass caps 14, namely, limiting the length of the plurality of glass caps 14 extending into the plurality of synthetic ceramic glass electrodes 12.

The one or more blocking member 15 as described above is die-cast on the glass tube 11 and the glass caps 14 to form a projective ring structure and increase the contact areas between the plurality of connecting members 13 and the glass tune 11. After connecting by a thermal treatment, the gaps between the plurality of synthetic ceramic glass electrodes 11 and the glass tube 11 can be sealed more effectively.

Figure 6:
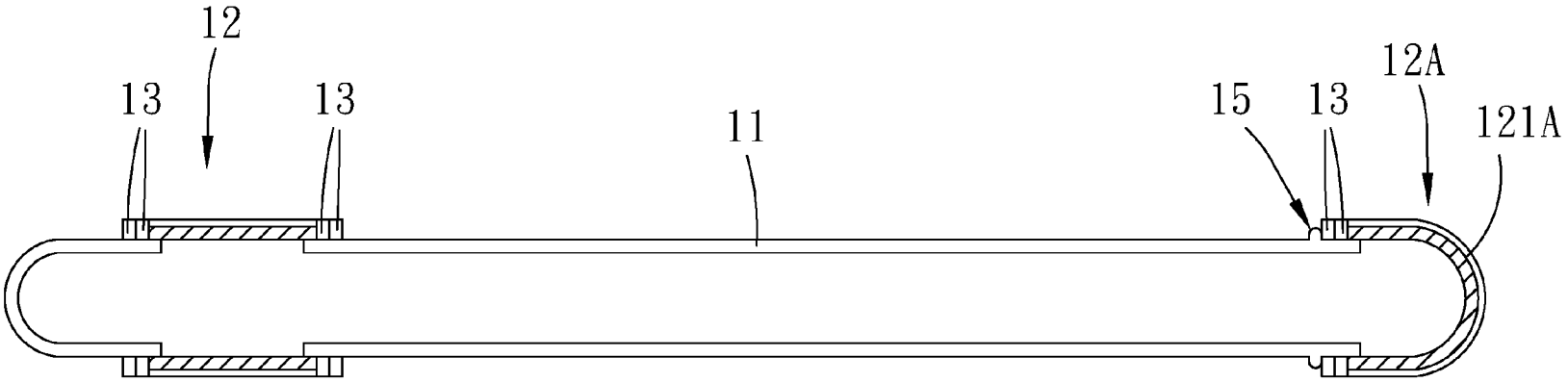
FIG. 6 shows a cross-sectional view of the lamp having synthetic ceramic glass electrodes according to the fourth embodiment of the present invention.

Please refer to FIG. 6, which shows a cross-sectional view of the lamp having synthetic ceramic glass electrodes according to the fourth embodiment of the present invention. As shown in the figure, the difference between the present embodiment and the first one is that a synthetic ceramic glass electrode 12A according to the present embodiment is cap-shaped. Then the glass cap 14 according to the previous embodiments can be omitted. The method for fixing the glass tube 11, the synthetic ceramic glass electrode 12A, and the plurality of connecting members 13 is identical to the one described in the first embodiment. Hence, the details will not be described again. In addition, the plurality of synthetic ceramic glass electrodes 12A according to the present embodiment further comprise a plurality of conductive layers 121A disposed on the outer surfaces of the plurality of synthetic ceramic glass electrodes 12A, respectively. The material of the plurality of conductive layers 121A can be silver or carbon. Besides, according to the present embodiment, the synthetic ceramic glass electrode 12A is not limited to be disposed at one end or both ends of the glass tube 11. It is variable according to the user's requirements.

Furthermore, the one or more blocking member 15 is disposed at one or more end of the glass tube 11. The plurality of connecting members 13 are disposed against the one or more blocking member 15. Then the synthetic ceramic glass electrodes 12A cover the opening of one or more end of the glass tube 11 and are disposed against the plurality of connecting members 13. According to the present embodiment, the fixing method for the one or more blocking member 15 of the glass tube 11, the synthetic ceramic glass electrodes 12A, and the plurality of connecting members 13 is identical to that according to the third embodiment. Hence, the details will not be described again.

Figure 7:
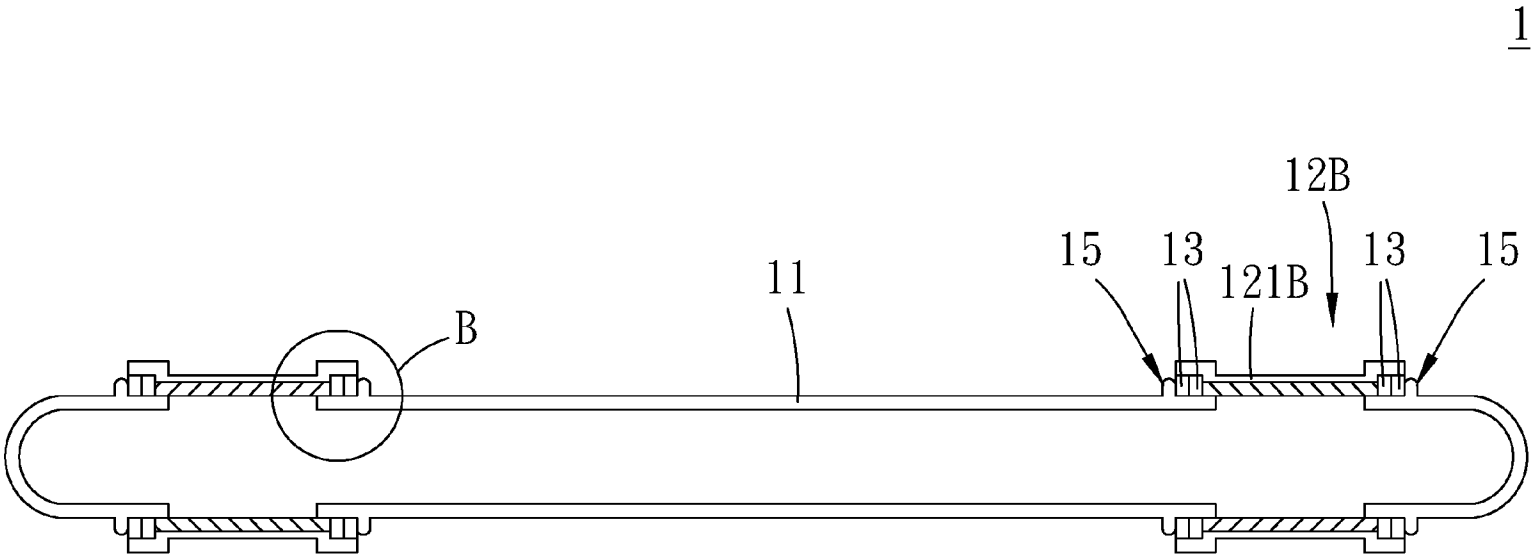
FIG. 7 shows a cross-sectional view of the lamp having synthetic ceramic glass electrodes according to the fifth embodiment of the present invention.
Figure 8:
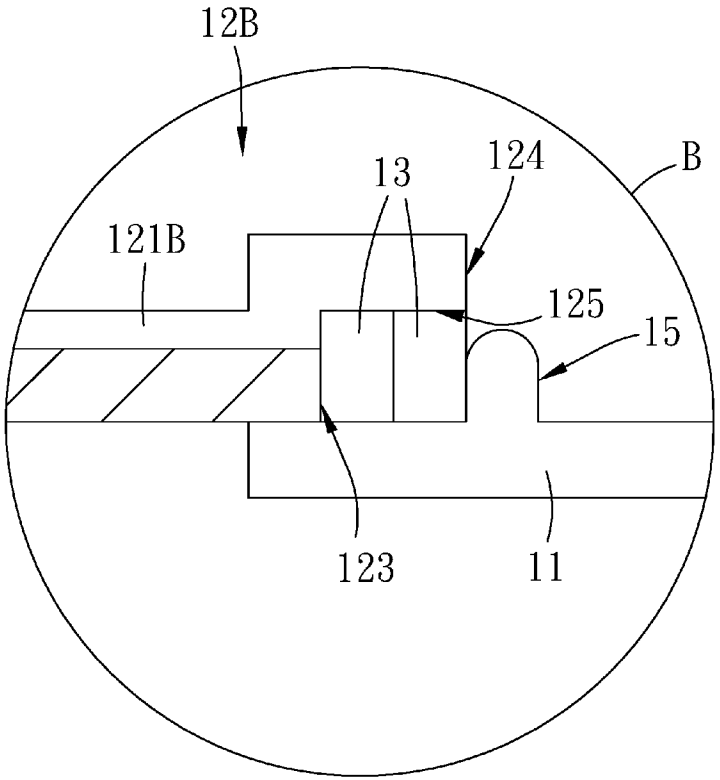
FIG. 8 shows an enlarged view of the region B in FIG. 7 according to the present invention.

Please refer to FIG. 7 and FIG. 8, which show a cross-sectional view and an enlarged view of the region B of the lamp having synthetic ceramic glass electrodes according to the fifth embodiment of the present invention. As shown in the figures, the difference between the present embodiment and the third one is that, one or more side of a plurality of synthetic ceramic glass electrodes 12B according to the present embodiment is ladder-shaped with two inner diameters. The synthetic ceramic glass electrode 12B includes a first end surface 123, a second end surface 124, and a sidewall 125. The first end surface 123 is the inner annular surface of the synthetic ceramic glass electrode 12B; the second end surface 124 is the outer annular surface of the synthetic ceramic glass electrode 12B; and the sidewall 125 is connected between the outer periphery of the first end surface 123 and the inner periphery of the second end surface 124. The present embodiment adopts the assembling method of the third embodiment. First, the plurality of connecting members 13 are put around the glass tube 11 until the side surface of one of the plurality of connecting members 13 is against the side surface of the one or more blocking member 15. Then the plurality of synthetic ceramic glass electrodes 12B are put around the glass tube 11. The first end surface 123 thereof is pressed against the side surface of one of the plurality of connecting members 13. Thereby, the plurality of connecting members 13 are contained in the synthetic ceramic glass electrodes 12B. The sidewall 125 covers the outer side of the plurality of connecting members 13 such that the plurality of connecting members 13 are located between the first end surface 123 and the side surface of the one or more blocking members 15 and between the sidewall 125 and the surface of the glass tube 11.

According to the present embodiment, after the thermal treatment, the neighboring surfaces of the plurality of connecting members 13 are softened and connected to one another. One side surface of the connecting member 13 adjacent to the plurality of synthetic ceramic glass electrodes 12 is attached to the first end surface 123 of the synthetic ceramic glass electrode 13. In addition, one side surface of the connecting member 13 adjacent to the one or more blocking member 15 is attached to the side surface of the one or more blocking member 15. The inner side of the plurality of connecting members 13 is attached to the surface of the glass tube 11. The outer side of the plurality of connecting members 13 is attached to the sidewall 125. Besides, while attaching using the thermal treatment, due to the limited fluidity of the plurality of connecting members 13, the plurality of connecting members 13 will not flow into the glass tube 11 via the junction of the plurality of synthetic ceramic glass electrodes 12B and the glass tube 11 and affecting the light-emitting performance of the lamp 1. By adopting the attaching and fixing method for the plurality of connecting members 13 according to the present embodiment, the gaps between the plurality of synthetic ceramic glass electrodes 12 and the glass tube 11 can be sealed effectively. In addition, the structural strength of the plurality of synthetic ceramic glass electrodes 12 and the glass tube 11 after attaching and fixing is enhanced as well. Furthermore, the one or more blocking member 15 in the structure of the present embodiment can be removed as another embodiment. Moreover, the plurality of synthetic ceramic glass electrodes 12B according to the present embodiment further comprise a plurality of conductive layers 121B disposed on the outer surfaces of the plurality of synthetic ceramic glass electrodes 12B, respectively. The material of the plurality of conductive layers 121B can be silver or carbon.

To sum up, the present invention provides a lamp having synthetic ceramic glass electrodes, which comprises the glass tube, the plurality of synthetic ceramic glass electrodes, and the plurality of connecting members. The plurality of connecting members are used for connecting the plurality of synthetic ceramic glass electrodes and the plurality of connecting members. Then a thermal treatment method is adopted for connecting the plurality of connecting members to one another after being softening. The connecting member adjacent to the synthetic ceramic glass electrode is softened and attached to the synthetic ceramic glass electrode; the connecting member away from the synthetic ceramic glass electrode is softened and attached to the glass tube. Because the difference between the thermal expansion coefficients of the synthetic ceramic glass electrode and the connecting member adjacent to the synthetic ceramic glass electrode is small, the difference between the thermal expansion coefficients of the connecting member and another connecting member adjacent to the connecting member is small. In turn, the difference between the thermal expansion coefficients of the glass tube and the connecting member away from the synthetic ceramic glass electrode is small as well. Consequently, while performing the thermal treatment, the glass tube, the synthetic ceramic glass electrodes, and the plurality of connecting members are sealed tightly in the condition of volume expansion. Then in the condition of cooling and fixing, the differences in volume contraction among the glass tube, the synthetic ceramic glass electrodes, and the plurality of connecting members are not significant, avoiding detachment of the sealed gaps. In addition, the one or more blocking member is disposed at one or more end of the glass tube. The plurality of connecting members are disposed against the one or more blocking members. Thereby, the gaps between the plurality o synthetic ceramic glass electrodes and the glass tube can be sealed more effectively.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

What is claimed is:

1. A lamp having synthetic ceramic glass electrodes, comprising:

a glass tube;

a plurality of connecting members, disposed at one or more end of said glass tube; and a plurality of synthetic ceramic glass electrodes, disposed at both ends of said glass tube, respectively, and said plurality of connecting members connecting one or more of said plurality of synthetic ceramic glass electrodes and said glass tube, respectively;

where said plurality of connecting members have different thermal expansion coefficients, respectively.

2. The lamp having synthetic ceramic glass electrodes of claim 1, and further comprising one or more blocking members disposed at one or more end of said glass tube, and said plurality of connecting members disposed against said one or more blocking member.

3. The lamp having synthetic ceramic glass electrodes of claim 1, wherein the neighboring surfaces if said plurality of connecting members are connected to one another; the side surfaces of said plurality of connecting members adjacent to said plurality of synthetic ceramic glass electrodes are attached to a side end surface of said plurality of synthetic ceramic glass electrode, respectively; and said plurality of connecting members away from said plurality of synthetic ceramic glass electrodes are attached and fixed on the surface of said glass tube.

4. The lamp having synthetic ceramic glass electrodes of claim 1, wherein the difference between the thermal expansion coefficient of said plurality of connecting members adjacent to said plurality of synthetic ceramic glass electrodes and the thermal expansion coefficient of said plurality of synthetic ceramic glass electrodes is smaller than the difference between the thermal expansion coefficient of said plurality of connecting members away from said plurality of synthetic ceramic glass electrodes and the thermal expansion coefficient of said plurality of synthetic ceramic glass electrodes.

5. The lamp having synthetic ceramic glass electrodes of claim 4, wherein the thermal expansion coefficient of said plurality of connecting members adjacent to said plurality of synthetic ceramic glass electrodes is between 115 and 125.

6. The lamp having synthetic ceramic glass electrodes of claim 1, wherein the difference between the thermal expansion coefficient of said plurality of connecting members away from said plurality of synthetic ceramic glass electrodes and the thermal expansion coefficient of said glass tube is smaller than the difference between the thermal expansion coefficient of said plurality of connecting members adjacent to said plurality of synthetic ceramic glass electrodes and the thermal expansion coefficient of said glass tube.

7. The lamp having synthetic ceramic glass electrodes of claim 6, wherein the thermal expansion coefficient of said plurality of connecting members opposing to said plurality of synthetic ceramic glass electrodes is between 92 and 103.

8. The lamp having synthetic ceramic glass electrodes of claim 1, wherein the softening temperatures of said plurality of connecting members are identical.

9. The lamp having synthetic ceramic glass electrodes of claim 8, wherein said softening temperature is between 545° C. and 555° C.

10. The lamp having synthetic ceramic glass electrodes of claim 1, wherein the material of said plurality connecting members is glass.

11. The lamp having synthetic ceramic glass electrodes of claim 1, wherein said connecting member is a sleeve or a gel.

12. The lamp having synthetic ceramic glass electrodes of claim 1, wherein said plurality of synthetic ceramic glass electrodes are cap-shaped.

13. The lamp having synthetic ceramic glass electrodes of claim 1, wherein one or more side of said plurality of synthetic ceramic glass electrodes is ladder-shaped with two inner diameters; said synthetic ceramic glass electrode includes a first end surface, a second end surface, and a sidewall; said first end surface is the inner annular surface of said synthetic ceramic glass electrode; said second end surface is the outer annular surface of said synthetic ceramic glass electrode; said sidewall is connected between the outer periphery of said first end surface and the inner periphery of said second end surface; and said first end surface of said synthetic ceramic glass electrode is disposed against the side surface of one of said plurality of connecting members.

* * * * *